US005421135A

United States Patent [19]

Stevens et al.

[11] Patent Number: 5,421,135

[45] Date of Patent: Jun. 6, 1995

[54] INTERLOCKING BUILDING BLOCKS

[75] Inventors: Hal B. Stevens, Woodland; Jeffrey D. Stevens, Vancouver, both of Wash.

[73] Assignee: Concrete Shop, Inc., Vancouver, Wash.

[21] Appl. No.: 84,403

[22] Filed: Jun. 29, 1993

[51] Int. Cl.[6] ..... E04C 1/10

[52] U.S. Cl. ..... 52/604; 52/606; 52/608; 405/284

[58] Field of Search ..... 52/604 OR, 605, 606, 52/608, 592.1, 592.6; 446/102, 104, 128; 405/284

[56] References Cited

U.S. PATENT DOCUMENTS

| | | | |
|---|---|---|---|
| D. 336,686 | 6/1993 | Pederson . | |
| 786,250 | 3/1905 | Dunham | 52/606 X |
| 1,886,404 | 11/1932 | Kipple | 52/606 |
| 2,060,701 | 11/1936 | Tropiano . | |
| 2,095,012 | 10/1937 | Renkert . | |
| 2,262,199 | 11/1941 | Paulson . | |
| 2,826,906 | 3/1958 | Rice | 52/606 |
| 3,030,093 | 4/1962 | Reintjes | 52/605 |
| 3,195,266 | 7/1965 | Onanian . | |
| 3,537,687 | 11/1970 | Adelman | 52/606 |
| 3,618,279 | 11/1971 | Sease . | |
| 3,936,989 | 2/1976 | Hancock . | |
| 4,107,894 | 8/1978 | Mullins | 52/606 |
| 4,124,961 | 11/1978 | Habegger . | |
| 4,186,540 | 2/1980 | Mullins . | |
| 4,514,949 | 5/1985 | Crespo . | |
| 4,516,364 | 5/1985 | Heider . | |
| 4,573,301 | 3/1986 | Wilkinson . | |
| 4,825,619 | 5/1989 | Forsberg . | |
| 4,878,324 | 11/1989 | Rissel . | |
| 4,965,979 | 10/1990 | Larrivee et al. | 52/608 |
| 5,003,746 | 4/1991 | Wilston | 52/592.1 |
| 5,154,032 | 10/1992 | Ritter | 52/605 |

FOREIGN PATENT DOCUMENTS

2936640A1 3/1980 Germany .

*Primary Examiner*—Carl D. Friedman
*Assistant Examiner*—Wynn E. Wood
*Attorney, Agent, or Firm*—Marger Johnson McCollom & Stolowitz

[57] ABSTRACT

The invention is a modular-shaped, lightweight concrete block that can be pivotally interlocked with other blocks of the same size without having to use grout and pins or additional attachment apparatus. The building block comprises a pair of vertically aligned side faces and horizontally aligned top and bottom faces that are joined at opposite lateral ends with rounded end faces. A pair of tenons extend out the top face of the block at opposite lateral ends and are coaxially aligned with complementary mortises formed into the bottom face. The unique end face configuration in combination with the location of the tenon, allow two adjacent blocks to be interlocked together in a wide range of angles. The invention also includes a novel handle configuration that is located in the middle of the block.

20 Claims, 4 Drawing Sheets

INTERLOCKING BUILDING BLOCKS

BACKGROUND OF THE INVENTION

This invention relates generally to a novel building block, and more particularly to a modular building block that is interlocked with similar blocks to form high strength structures in a wide variety of different configurations such as retaining walls and various types of support structures.

Building blocks are used in a wide variety of applications such as in retaining walls for securing earth embankments and in support structures for holding various items above ground. The blocks are typically superimposed on top of each other in multiple layers. To reduce the time and cost of constructing walls and alternative support structures, it is desirable to assemble the blocks without having to use mortar, auxiliary pins, or additional attachment apparatus. However, a wall assembled by simply laying blocks on top of each other in multiple layers, does not provide sufficient inter-structural support for many applications.

Various interlocking blocks have been used to increase the overall structural integrity of walls. For example, U.S. Pat. No. 3,936,989 to Hancock describes blocks that have longitudinally extending ribs and grooves that interlock with the grooves and ribs of vertically adjacent blocks of the same shape. U.S. Pat. No. 4,124,961 to Habegger describes building blocks having longitudinally extending triangular ridges and a complementary depression that engage with similar bricks to restrain brick movement in a transverse direction.

The blocks described in Hancock and Habegger, however, can only be interlocked in one direction. Therefore, special separate end pieces must be used in order to change wall directions. For example, if a wall changes directions by 90 degrees, special corner blocks must be manufactured that engage with adjacent blocks oriented at 90 degree angles. Special end blocks increase the overall cost of building the wall and can also reduce structural integrity. Using special corner blocks for each directional change also limit the number of wall configurations that can be built.

U.S. Pat. No. 5,154,032 to Ritter describes a block that engages at various angles with blocks of similar design. Each block has a rectangular main portion that is connected at one end to a bulbous portion. The bulbous portion is received into a concave socket region of a second block. The bulbous portion and the concave socket, however, do not provide a positive interlock between overlapping block layers. Thus, a wall fabricated from this type of block is not as structurally sound as alternative interlocking block systems.

The opposite lateral ends of the block in Ritter are also not symmetric. Therefore, one block cannot be used for making multiple end pieces. For example, blocks in vertically adjacent rows are typically offset to increase overall wall strength. Because each row is skewed, half-bricks must be used at the end of the wall in every other row to provide a vertically straight wall edge. If each block had symmetric ends, one block could be used to make two half-blocks. However, each end of the block described in Ritter has a different configuration. Therefore, only one half-block can be made from each block. This further increases the overall cost of constructing a wall.

In general, building blocks are heavy and hard to grab onto making installation difficult. Because building blocks are hard to lift and carry, they are often dropped during transport, either damaging the block itself or damaging the surface that the block is dropped on.

Accordingly, a need remains for an easy to carry building block that is easily assembled into a wide variety of different interlocking structural configurations.

SUMMARY OF THE INVENTION

It is, therefore, an object of the invention to increase the variety of structural configurations that can be assembled from a single type of interlocking building block.

Another object of the invention is to reduce the time and cost of assembling building blocks into different structural configurations.

A further object of the invention is to increase the strength of structures made from building blocks.

The invention relates to a modular-shaped, lightweight concrete block that uses a mortise and tenon to interlock with blocks of similar shape without using grout, pins, or any additional attachment apparatus. The tenon and mortise configuration allow vertically adjacent blocks to be interlocked at a large range of angles within a horizontal plane.

Since, adjacent blocks can be interlocked together in a wide range of angles, a wider variety of structures can be assembled using a single block type. For example, multiple blocks can be assembled into walls having corners and curvatures that cannot presently be assembled with current interlocking block systems. Since, the blocks are interlocked, the wall has a stronger interstructure than walls assembled from non-interlocking building blocks.

The same block type can also be used to assemble additional support structures. For example, in one embodiment, a column is formed and interlocked with the blocks in a wall to increase wall stability, Alternatively, the same block type can be used to form shelves that are interlocked with the blocks in the wall to support various items above the ground. The building blocks can also be assembled into alternative stand-alone support structures. For example, the blocks can be assembled into columns of various radius and height. The columns can also be formed with internal cavities used for surrounding or holding various items.

To further simplify installation, a handle is joined in the middle of the block between two side walls. Opposite lateral ends of the block are thereby balanced about the handle as the block is being lifted vertically upward. The handle has a generally square cross-sectional shape that tapers in from the opposite side walls allowing it to be easily gripped with one hand. Therefore, the handle allows blocks of different size and weight to be easily lifted and carried in each hand with more control and with less effort.

Thus, the blocks according to the invention provide an easy-to-install inexpensive means for assembling walls and various structures. The capacity to positively interlock the blocks together at various angles increase the overall strength of the assembled structure while, at the same time, increasing the variety of structures that can be assembled with a single modular-shaped block. In addition, the block provides a unique handle configuration that allow blocks to be easily assembled.

Specifically, each block comprises a pair of longitudinally extending side faces joined by a flat top and bottom face. A pair of end faces are joined to the side, top, and bottom faces at opposite lateral ends of the block. The tenons are attached to and extend out from the top face at opposite lateral ends of the block. In the preferred embodiment, each tenon is coaxially aligned with a complimentary mortise formed into the bottom face. Each end face is rounded about an associated tenon at a predetermined radial distance and joined by a pair of oppositely inclining faces to opposite side faces.

Each block is sized so that two vertically adjacent blocks can interlock at the same time with the tenons of a lower block. The blocks can be interlocked at any angle within a predetermined range. For example, each vertically adjacent block can be interlocked at any angle within a predetermined range of 180 degrees. Each block is sized so that the end faces abut with the end faces of a horizontally adjacent block. Therefore, a continuous wall face, free from voids, is possible for any configurable wall shape.

A top cover can be interlocked to the top of each block to further improve the structures aesthetic appeal. The top cover has an outline corresponding to the cross-sectional shape of the block with a pair of mortise formed in a bottom side. To further increase aesthetic appeal, portions of the side and end faces are provided with a molded cement finish.

The blocks can also be split symmetrically down the center forming two half-blocks of substantially the same dimensions. The half-blocks can be interlocked in alternative rows at the end of a wall to form a generally straight vertical wall edge. The over-all cost of constructing the wall is thereby reduced, since one block can be used to make two half-blocks.

The foregoing and other objects, features and advantages of the invention will become more readily apparent from the following detailed description of a preferred embodiment of the invention which proceeds with reference to the accompanying drawings.

DETAILED DESCRIPTION

Figure 1:
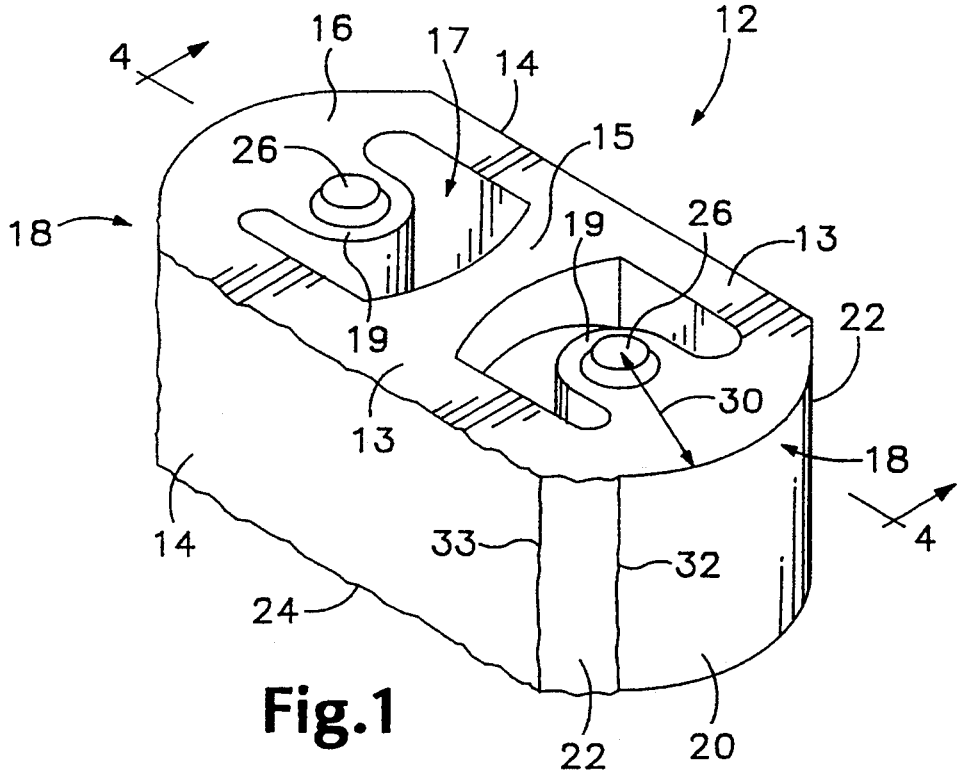
FIG. 1 is a perspective view of a building block according to the invention.
Figure 2:
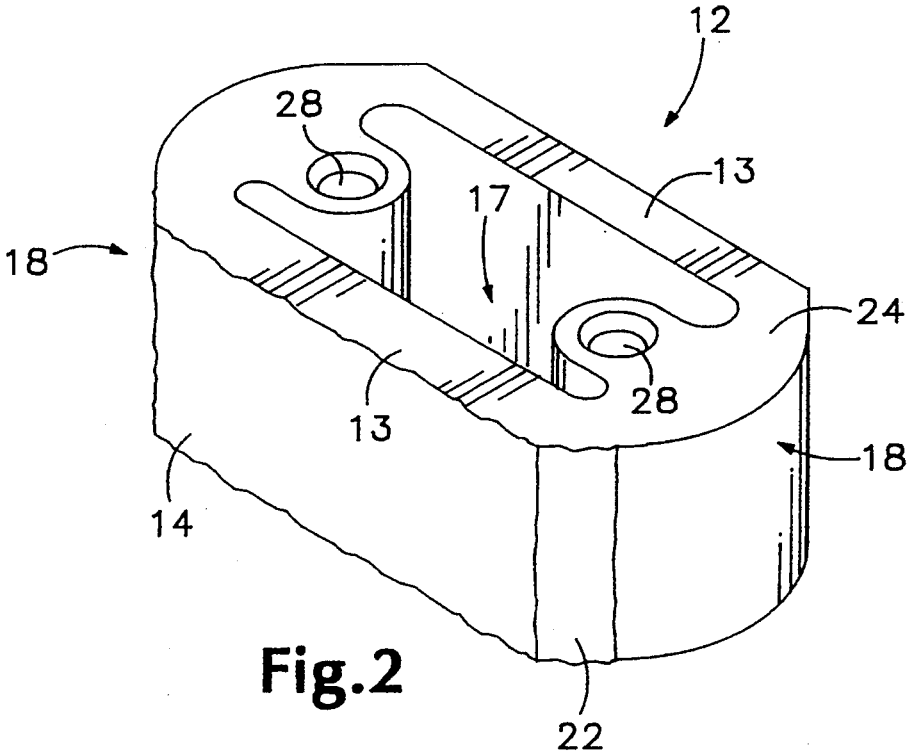
FIG. 2 is a perspective view of the building block shown in FIG. 1 in an inverted position.

FIG. 1 is a perspective view of a building block 12 according to the invention and FIG. 2 is a perspective view showing building block 12 in an inverted position. The building block 12 comprises a pair of vertically aligned elongate side walls 13 each having an outside face 14. A pair of end sections 18 are joined at opposite lateral ends of the side walls 13 defining an elongate cavity 17. A horizontal top face 16 is joined at the top of each side wall 13 and the top of each end section 18 and a horizontal bottom face 24 is joined at the bottom of each side wall 13 and the bottom of each end section 18. A handle 15 is joined in the middle of the block between the two side walls 13.

Each end section 18 has a protuberance 19 that extends into cavity 17. The outside face of each end section 18 includes oppositely inclining faces 22 that extend from an end 33 of each side face 14 to an opposite side 32 of a rounded end face 20. A pair of tenons 26 are attached to and extend up from the top of each protuberance 19. A mortise 28 (FIG. 2) is formed into the bottom of each protuberance 19 and is coaxially aligned with a corresponding tenon 26.

Each tenon 26 has a circular cross-sectional shape that allow a mortise from a second vertically adjacent block to be interlocked with the tenon at a large range of angles within a horizontal plane. Tenons 26 are located a predetermined radial distance 30 from end face 20. Each block is sized so that two vertically adjacent blocks of the same size can interlock with the tenons 26 on top of block 12 at the same time. The two vertically adjacent blocks can interlock with tenons 26 at any angle within a 180 degree range, as will be discussed in further detail below.

Figure 3:
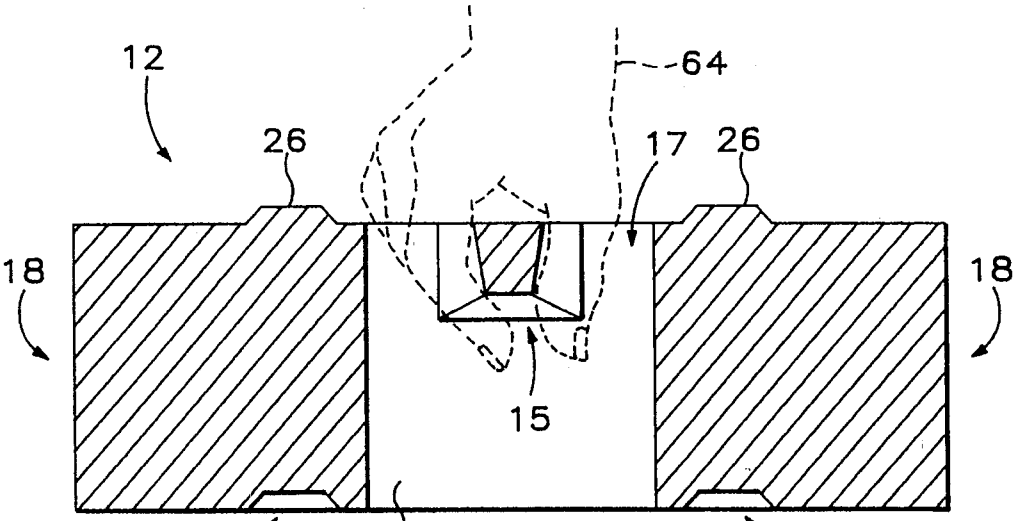
FIG. 3 is a front-sectional view of the building block and handle shown in FIG. 1.

FIG. 3 is a front-sectional view of handle 15 shown in FIG. 1. The handle 15 is joined at the top of cavity 17 between the two side walls 13 midway between the two end sections 18. Handle 15 has a generally square cross-sectional shape that tapers in from the opposite side walls allowing easy lifting with a hand 64.

Since handle 15 is located midway between the two end sections 18, the opposite lateral ends of the block are balanced about the handle as the block is being lifted vertically upward. Generally, building blocks are difficult to lift and carry. For example, blocks are typically grabbed from the side and carried awkwardly at different angles. Handle 15 allows heavier blocks to be lifted with less effort and with more control. Therefore, two blocks to be carried at the same time in opposite hands. Since block 12 is easier to lift and carry, structures made from block 12 are quicker and easier to assemble.

In one embodiment of the invention, block 12 is made out of concrete and is approximately 18 inches long, 6 inches high, 9 inches wide and has a weight of approximately 32 pounds. At least one side face 14 and the oppositely extending slant faces 22 can be made with a textured concrete finish and different colors to provide various visual effects. For example, the finish can be textured and colored to look like granite. Alternatively, all exterior surfaces of block 12 can have a smooth concrete surface. Block 12 is also easily manufactured from alternate materials such as plastic.

Figure 4:
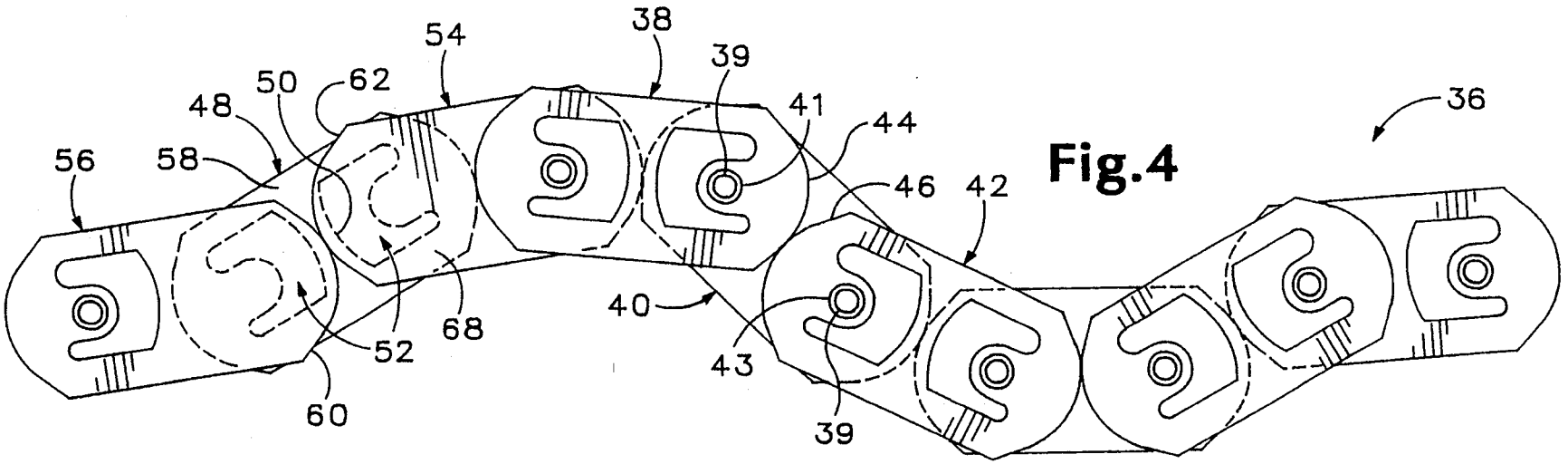
FIG. 4 is a top view of a multi-angled wall assembled from multiple blocks of the type shown in FIG. 1.

FIG. 4 is a top view of a wall 36 assembled from multiple blocks of the type shown in FIG. 1. Blocks 38 and 42 reside on a top row of wall 36 and are superimposed on top of a block 40. Block 40 has a pair of tenons 39 that interlock into corresponding mortise 41 and 43 from blocks 38 and 42, respectively. In the interlocked position, an end face 44 of block 38 abuts against an end face 46 of block 42. It can be seen that blocks 38 and 42 are both interlocked onto the top of block 40 at different angles. Therefore, wall 36 can be assembled in a wide variety of different curvatures to conform to different physical obstructions. For example, curvatures in wall 36 can be assembled with a large radius to conform around the corner of a yard or can be assembled to have a small radius to surround a tree.

It is important to note that the end faces 44 and 46 of blocks 38 and 42, respectively, abut together regardless of what angle they are interlocked to block 40. This eliminates visible voids in wall 36 that would typically be created with blocks having rectangular cross-sectional profiles. A continuous wall surface (i.e., no voids) increases privacy, provides superior noise insulation, and has a more aesthetically appealing outside appearance. It is also desirable to maintain a continuous running wall surface so that dirt does not seep through wall 36, for example, when block 12 are used to assemble a retaining wall.

The handle 15 on each building block, in addition to providing easy means for carrying block 12 (FIG. 1) also adds additional support at the ends of two vertically adjacent interlocked blocks. For example, a block 48 is shown interlocked underneath a block 54 and a block 56. A handle 50 is joined between opposite side walls 58 of block 48. Handle 50 rests underneath an end face 60 of block 56 and underneath an end face 62 of block 54. Thus, handle 50 provides additional vertical support for blocks 54 and 56. Handle 50 also allows blocks 54 and 56 to completely cover cavity 52 of block 48. Without handle 50, cavity 52 would be visible between end faces 60 and 62, reducing the overall aesthetic appeal of wall 36.

Figure 5:
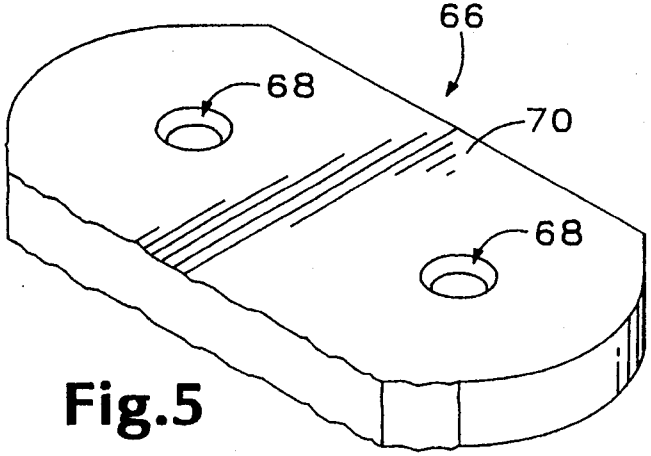
FIG. 5 is a perspective view of a top cover attachable to the block shown in FIG. 1.

FIG. 5 is a perspective view of a cover 66. The cover 66 has an outline corresponding to the cross-sectional profile of block 12 (FIG. 1) and has mortises 68 formed in a bottom side 70. The mortise interlock with the tenons 26 extending from the top face 16 of block 12 (FIG. 1). Cover 66 is used as a finishing piece for the top of structures assembled with block 12. However, cover 66 can also be used as a step or shelf on the side of a wall as will be further described below and is typically made from the same material as block 12, for example, concrete.

Figure 6:
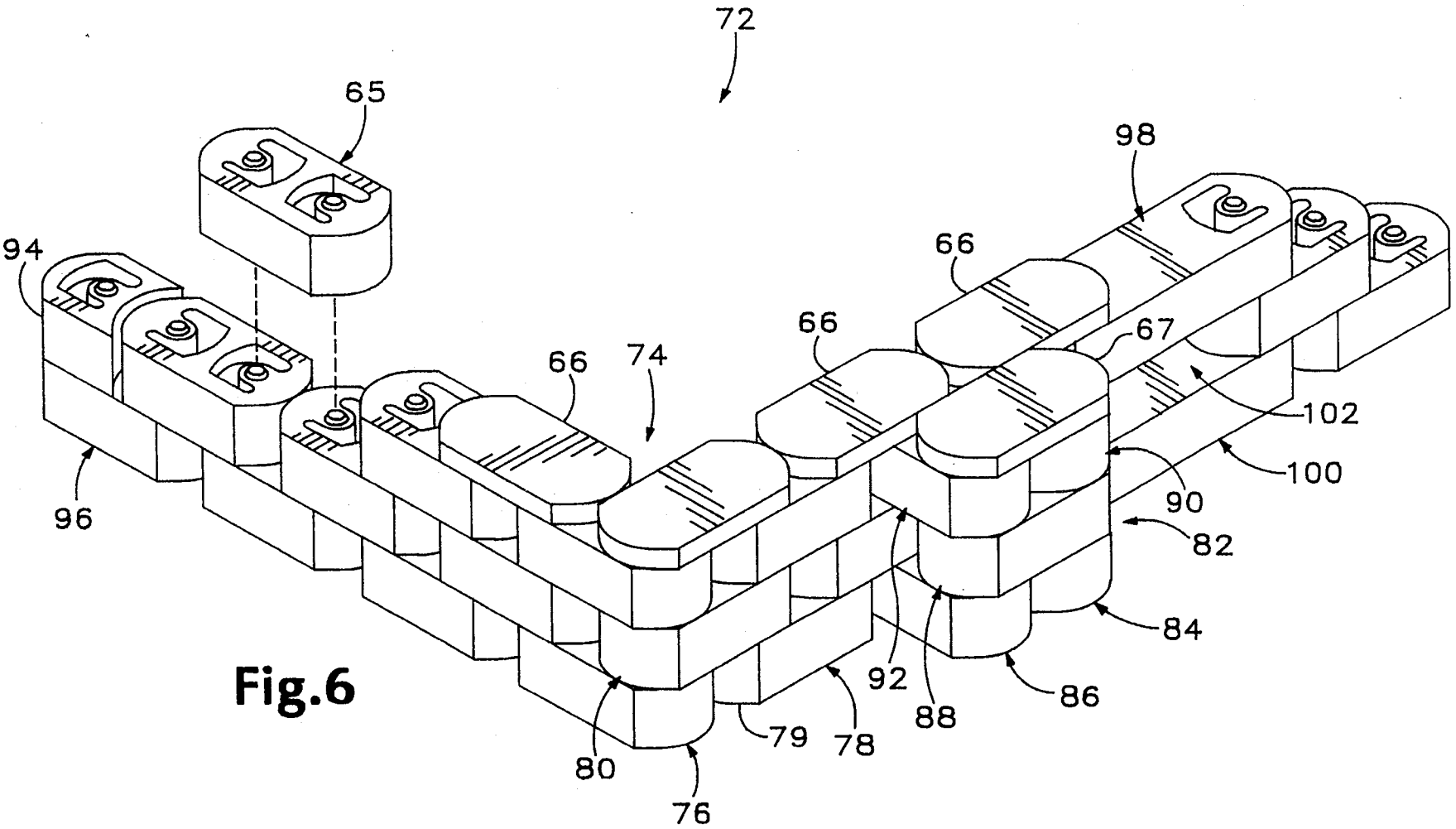
FIG. 6 is a perspective view of an alternative wall configuration assembled from multiple blocks of the type shown in FIG. 1.

FIG. 6 is a perspective view of an alternative wall configuration 72 using multiple blocks of the type shown in FIG. 1. A first vertically aligned row of blocks are placed end-to-end on a level surface with the tenons of each block extending upward. A second row of wall 72 is interlocked with the first row by placing the mortise from each block in the second row over tenons of two adjacent blocks from the first row as shown by block 65. Additional rows are attached in the same manner until wall 72 reaches a desired height.

By interlocking the blocks in each row together, wall 72 forms a continuous running interlocked wall that can be configured into different angles. For example, a 90 degree corner 74 can be formed in wall 72 by interlocking blocks 76 and 80 together at 90 degree angles. Wall 72, while changing directions at corner 74, still maintains a continuous interlocked structure. Even though block 76 and block 79 are interlocked to block 80 at a 90 degree angle, end 79 of a block 78 still abuts against the side of block 76. Thus, wall 72 maintains a continuous wall face free from voids regardless of the angle of corner 74.

Cap covers 66, as previously shown in FIG. 5, are interlocked at the top of wall 72 between the tenons of horizontally adjacent blocks. However, cover 66 can also be aligned directly over the tenons of a single block.

Wall 72 can be assembled with additional support structures. For example, a column 82 is assembled by placing blocks 84 and 86 side-by-side at an angle perpendicular with wall 72. Tenons from a first end of block 84 and 86 are interlocked with corresponding mortise extending down from blocks in the second row of wall 72. A block 88 is then interlocked over the tenons at a second end of blocks 84 and 86. The column is built further up the side of wall 72 by placing another set of perpendicular side-by-side blocks 90 and 92 in the third row of wall 72 over block 88. Additional blocks are interlocked in wall 72 until column 82 reaches a desired height. The column provides additional support for wall 72.

Alternatively a single pair of side-by-side perpendicular blocks can be interlocked anywhere along the side of wall 72. A cover 67 can then be interlocked over the two side-by-side blocks creating a shelf or step. The shelf, step, or column can be made at any width or height and can be placed at multiple locations on either side of wall 72.

To reduce the cost of assembling wall 72, a block 12 can be split down the center to form first and second half-blocks of substantially the same dimensions. Each half block is interlocked in every other row at the ends of wall 72. For example, a half-block 94 is locked over a single tenon on a block 96 to form a vertically straight edge along the end of wall 72. Because each block is symmetric about the middle, two half-blocks can be made from a single block reducing the total number of blocks required to assemble wall 72.

Blocks 98 and 100 are alternative block embodiments according to the invention. Longer blocks, such as blocks 98 and 100, reduce the overall number of blocks required to make wall 72. Longer blocks can also be used to create openings, such as void 102, in the side of wall 72.

Figure 7:
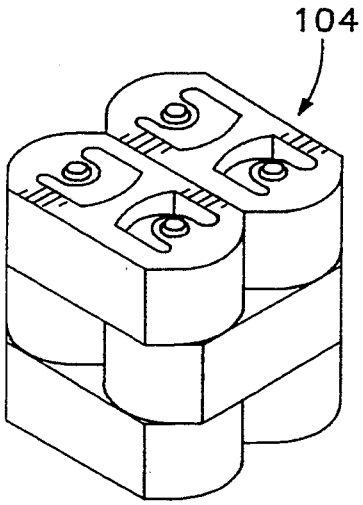
FIG. 7 is a perspective view of a zero-radius column assembled from multiple blocks of the type shown in FIG. 1.

FIG. 7 is a perspective view of a zero-radius column 104 assembled from multiple blocks of the type shown in FIG. 1. A first row of column 104 is formed by placing two blocks side-by-side. A second row of column 104 is then formed by interlocking two blocks in a perpendicular direction over the blocks in the first row. The blocks in each subsequent row are interlocked in the same manner until column 104 reaches a desired height. Column 104 can be used as a support structure for holding various items above the ground.

Figure 8:
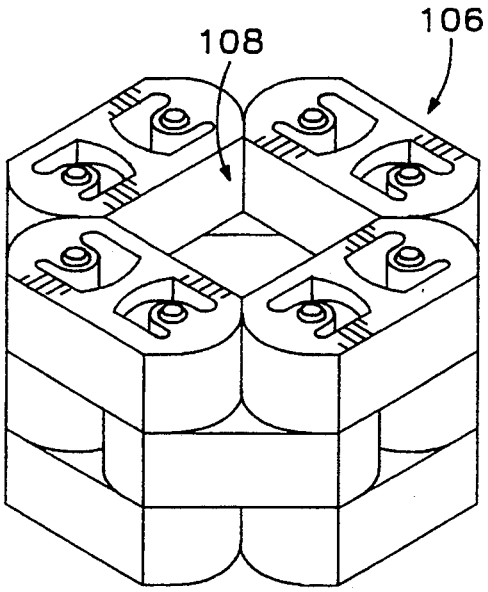
FIG. 8 is a perspective view of a tight-radius column assembled from multiple blocks of the type shown in FIG. 1.

FIG. 8 is a perspective view of a tight-radius column 106 assembled from multiple blocks of the type shown in FIG. 1. A bottom row of column 106 is formed by placing four blocks end-to-end in a circle. Each block being perpendicular with the two immediately adjacent blocks. A second row of column 106 is then formed by interlocking blocks over the ends of adjacent blocks in the first row. Additional rows are formed in the same manner until column 106 reaches a desired height. Column 106 has a wider base than column 104 (FIG. 7) providing a more stable support structure. In addition, column 106 has a vertically aligned cavity 108 that can be used to hold various items or, alternatively, surround vertically aligned structures, such as a trees or poles.

Figure 9:
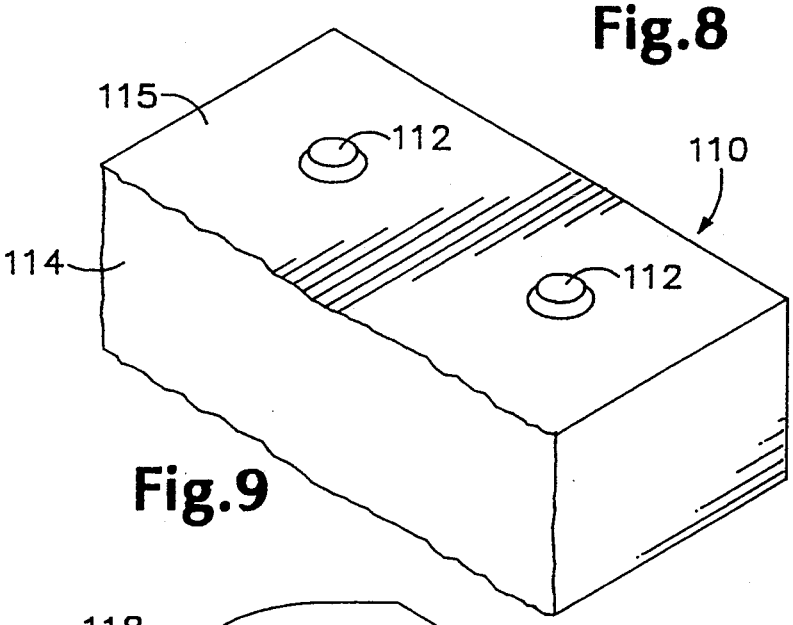
FIG. 9 is a perspective view of another embodiment of an interlocking block according to the invention.

FIG. 9 is a perspective view of an alternative embodiment of a block 110 according to the invention having a rectangular cross-sectional shape. Block 110 includes tenons 112 attached to and extending up from a top face 115. A pair of corresponding mortise (not shown) are formed into the bottom of block 110. Block 110 can be made with a molded front face 114 that gives the appearance that block 110 is made out of a different material, for example, stone or granite. Alternatively, block 110 can be completely solid with consistent exterior faces. For example, block 110 can be a brick.

Figure 10:
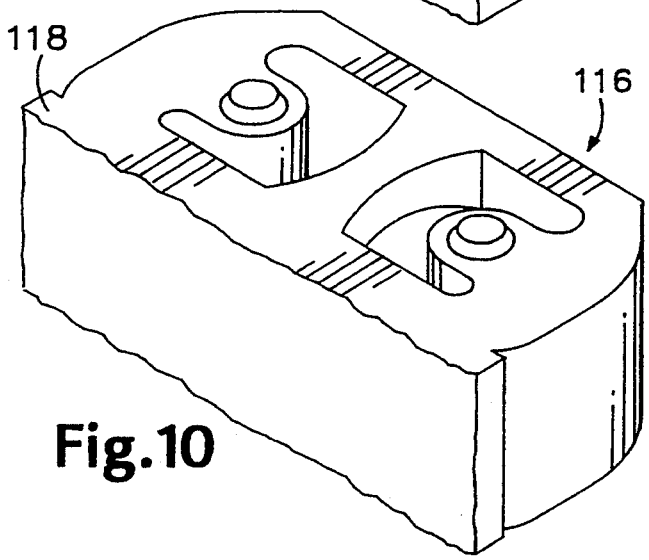
FIG. 10 is a perspective view of a flat faced block according to the invention.

FIG. 10 is a perspective view of an alternative embodiment of a flat faced block 116 according to the invention. Block 116 is the same as block 12 (FIG. 1) except for a front side wall 118 that extends across the entire length of block 116. When viewed from the front, block 116 appears to have a rectangular cross-sectional shape. Block 116, however, has the added advantage of interlocking closer to horizontally adjacent blocks of similar shape at a wider range of angles than block 110 shown in FIG. 9. Thus, while appearing to be completely square from the front, block 116 has the added advantage of being interlocked in a wider variety of configurations.

Having described and illustrated the principles of the invention in a preferred embodiment thereof, it should be apparent that the invention can be modified in arrangement and detail without departing from such principles. I claim all modifications and variation coming within the spirit and scope of the following claims.

We claim:

1. A building block, comprising:

a pair of longitudinally extending side faces each having a top and a bottom end;

a pair of laterally extended end faces joined to the side faces at opposite lateral ends of the block defining an elongate cavity;

a pair of protuberances extending from opposite end faces into the cavity, each protuberance having a top face and bottom face and extending completely through the block from the top ends of the side faces to the bottom ends of the side faces; and a pair of tenons attached to and extending out from the top face of the protuberances at opposite lateral ends of the block, each tenon allowing engagement with a corresponding mortise from a vertically adjacent block at different angles within a horizontal plane.

2. A block according to claim 1 wherein each tenon has a circular cross-sectional shape.

3. A block according to claim 1 wherein each tenon is coaxially aligned with a complimentary mortise formed into the bottom face of the protuberance.

4. A block according to claim 1 wherein the side faces are sized to allow two vertically adjacent blocks of the same size to interlock with said tenons at the same time within a predetermined range of angles.

5. A block according to claim 4 wherein each vertically adjacent block can be interlocked at any angle within a predetermined range of 180 degrees.

6. A block according to claim 1 wherein each end face is rounded about an associated tenon at a predetermined radial distance.

7. A building block according to claim 1 wherein each end face includes a pair of oppositely inclining faces, each joined between an opposite side face and an opposite end of a rounded end face.

8. A block according to claim 1 wherein at least one side face has a rectangular shape with opposite lateral sides extending out to the opposite lateral ends of the block.

9. A building block according to claim 1 including a top cover having an outline corresponding to the cross-sectional shape of the block with a pair of mortises formed in a bottom side to accommodate the pair of tenons extending from the top face of the block.

10. A building block, comprising:

first and second elongate side walls;

a pair of end sections joined at opposite lateral ends of the side walls defining an elongate cavity having a top and bottom end, each end section including a protuberance extending into said cavity, each protuberance having a top and bottom face; and a handle having opposite side faces, a top face and a bottom face and joined at a top end of the cavity between the two side walls at a midpoint between the two end sections, the handle extending partially down the side walls so that the cavity extends along opposite side faces and completely underneath the bottom face of said handle thereby allowing a hand to wrap completely around the side, top and bottom faces of said handle at the same time.

11. A building block according to claim 10 wherein the handle has a generally square cross-sectional shape that tapers in from the opposite side walls.

12. A building block according to claim 10 wherein each protuberance includes a tenon extending up from the top face and a corresponding mortise extending into the bottom face.

13. A building block according to claim 10 wherein each end section includes a generally round exterior face.

14. A method for interlocking blocks, comprising:

providing multiple blocks of the same shape each having parallel sides joined together at opposite lateral ends by a pair of end faces and joined at the top and bottom by a horizontal top and bottom face, respectively;

providing a pair of tenons attached to and extending up from the top face at opposite lateral ends of each block and a pair of corresponding mortises formed in the bottom face of each block;

placing a first set of blocks horizontally adjacent to each other at various angles forming a first row, the end faces of horizontally adjacent blocks abutting against each other at each of the various angles; and interlocking a second set of blocks on top of the first row forming a second row, the second row of blocks interlocked by engaging the mortise extending down from the second row with the tenons extending up from the first row thereby forming a multi-layer interlocked structure configurable into a variety of different angles and curvatures.

15. A method according to claim 14 wherein the first and second rows are formed into a wall, the first row formed by placing the blocks end-to-end at various angles and the second row formed by interlocking the mortise from each block in the second row over the tenons from two adjacent blocks in the first row.

16. A method for interlocking blocks, comprising:

providing multiple blocks of the same shape each having parallel sides joined together at opposite lateral ends by a pair of end faces and joined at a top and bottom end by a horizontal top and bottom face, respectively;

providing a pair of tenons attached to and extending up from the top face at opposite lateral ends of each block and a pair of corresponding mortises formed in the bottom face of each block;

placing a first set of blocks horizontally adjacent to each other at various angles forming a first horizontal row; and interlocking a second set of blocks on top of the first row forming a second row, the second row of blocks interlocked by engaging the mortise extending down from the second row with the tenons extending up from the first row thereby forming a multi-layer interlocked wall configurable into a variety of different angles and curvatures; and assembling a support structure along the side of the wall, the support structure assembled by placing at least two blocks side-by-side at an angle generally perpendicular with the blocks in the first and second rows, and interlocking the blocks in the support structure with the blocks in the wall.

17. A method according to claim 15 including splitting one block symmetrically down the center forming first and second half-blocks of substantially the same dimensions and interlocking the first half-block at a first end of the first row for forming a generally straight vertical edge between the first and second rows.

18. A method according to claim 14 wherein the first and second rows are formed into a column, the first row formed by placing blocks side-by-side and the second row formed by interlocking blocks over horizontally adjacent blocks in the first row.

19. A wall, comprising:

superimposed rows of longitudinally aligned building blocks, each block having the same shape and including;

a pair of longitudinally extending side faces;

flat top and bottom faces joined to said side faces;

a pair of laterally extended end faces joined to the side, top, and bottom faces at opposite lateral ends of the block;

a pair of tenons attached to and extending out from the top face at opposite lateral ends of the block and a pair of corresponding mortise formed in the bottom face;

the tenons from each block capable of being interlocked together at a predetermined range of angles with the mortises of vertically adjacent blocks while at the same time the end walls of horizontally adjacent blocks abutting against each other at each horizontally rotatable position within the predetermined range of angles thereby forming a continuous running interlocked structure having a configurable cross-sectional shape.

20. A wall according to claim 19 wherein the end faces of each block are curved for abutting with the end faces of horizontally adjacent blocks at each angle within the predetermined range.

* * * * *